United States Patent [19]

Dossekker

[11] Patent Number: 4,596,175

[45] Date of Patent: Jun. 24, 1986

[54] REED MOUTHPIECE FOR MUSICAL WIND INSTRUMENT

[75] Inventor: Bruno Dossekker, Zurich, Switzerland

[73] Assignee: Walter Dunner, S.A., Moutier, Switzerland

[21] Appl. No.: 693,605

[22] Filed: Jan. 22, 1985

Related U.S. Application Data

[63] Continuation-in-part of Ser. No. 584,537, Feb. 28, 1984, Pat. No. 4,517,875.

[51] Int. Cl.[4] ..... G10D 9/02

[52] U.S. Cl. ..... 84/383 R

[58] Field of Search ..... 84/383

[56] References Cited

U.S. PATENT DOCUMENTS

| | | | |
|---|---|---|---|
| 1,748,077 | 2/1930 | Packman et al. | 84/383 R |
| 2,180,383 | 11/1939 | Anderberg | 84/383 R |
| 2,496,749 | 2/1950 | Reddick | 84/383 R |
| 4,517,875 | 5/1985 | Dossekker | 84/383 R |

FOREIGN PATENT DOCUMENTS

| | | | |
|---|---|---|---|
| 36069 | 10/1971 | Japan | 84/383 R |

*Primary Examiner*—Lawrence R. Franklin

*Attorney, Agent, or Firm*—Hauke and Patalidis

[57] ABSTRACT

A mouthpiece for a musical wind instrument. The mouthpiece has a casing and a reed attachment assembly mounted in a recess at the top of the casing. The reed attachment assembly has a bridge member pivotably connected to a frame. The foot of the reed is clampable against a plate portion of the pivotable bridge member such that the blade of the reed protrudes from the attachment assembly and extends above the top surface of the casing with the tip of the reed being disposed proximate the leading edge of the casing. An adjustment is provided for adjusting the inclination of the plate of the pivotable bridge member relative to the frame such that the distance between the tip of the reed and the leading edge of the mouthpiece casing can be adjustably varied.

9 Claims, 5 Drawing Figures

FIG. 1
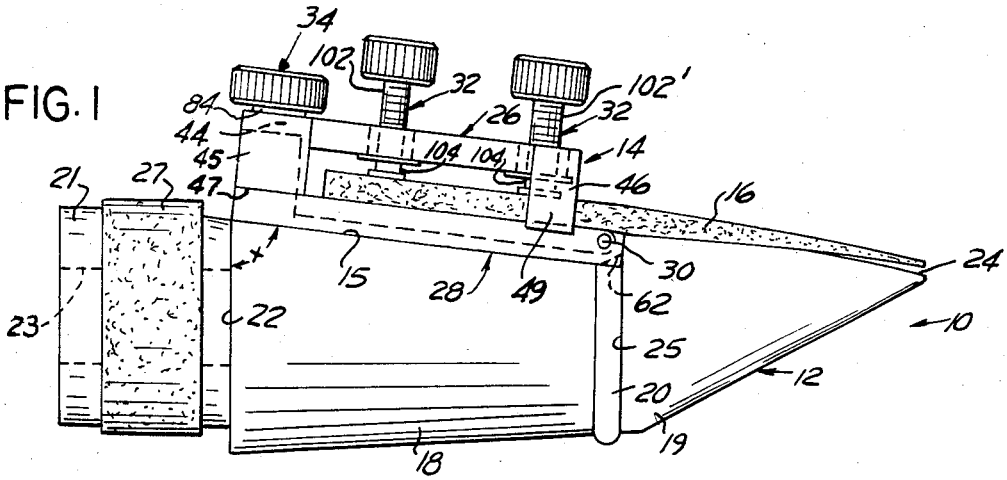
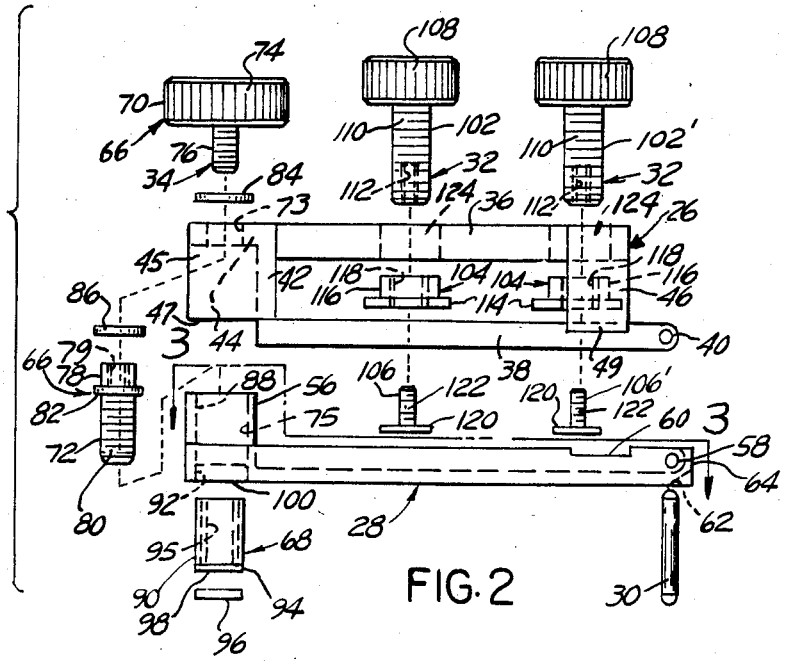
FIG. 2
FIG. 4
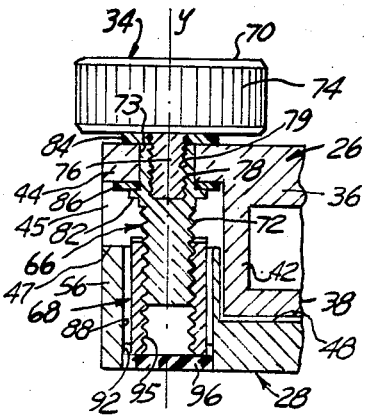
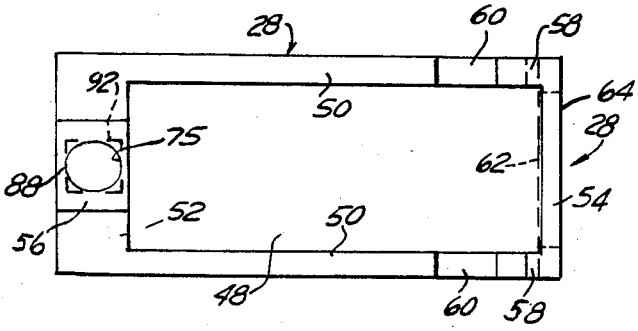
FIG. 3
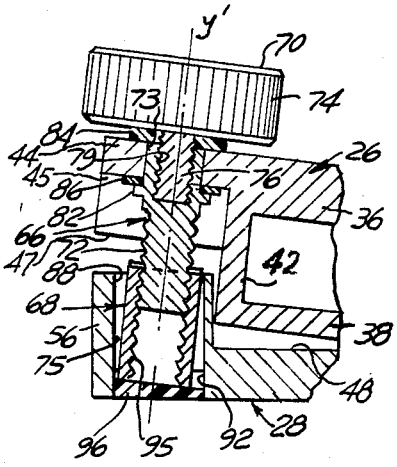
FIG. 5

REED MOUTHPIECE FOR MUSICAL WIND INSTRUMENT

CROSS-REFERENCE TO RELATED APPLICATION

This application is a Continuation in Part of Application Ser. No. 584,537 filed Feb. 28, 1984, now U.S. Pat. No. 4,517,875, assigned to the same assignee as the present application.

BACKGROUND OF THE INVENTION

In conventional mouthpieces for musical wind instruments, such as clarinet mouthpieces, for example, the foot portion of a bamboo reed is affixed to a support surface in the mouthpiece casing by means of a ligature. The blade of the reed protrudes above the top of the mouthpiece casing with the tip of the reed blade disposed proximate the leading edge of the casing.

The width of the gap between the tip of the reed blade and the top surface of the leading edge of the mouthpiece casing is an important factor in determining the quality of sound produced by the instrument, and, in the prior art, some mouthpieces of this type have been provided with adjustment means permitting the width of the blade-casing gap of the mouthpiece to be adjustably varied according to the preference of a musician. For example, U.S. Pat. No. 4,517,875, there is disclosed a wind instrument mouthpiece having a reed attachment assembly mounted at the top of a conventional mouthpiece casing. The reed attachment assembly comprises a reed support member pivotably connected to a frame, means for removably clamping the foot of a reed to a portion of the pivotable support member and means for adjusting the inclination of the support member relative to the frame.

The present invention is an improvement on the reed mouthpiece disclosed in the prior patent.

SUMMARY OF THE INVENTION

The principal object of the present invention is to provide an improved reed attachment assembly for a wind instrument mouthpiece having a reed support or bridge member pivotably connected to a frame, and adjustment means enabling a user to vary the inclination of the bridge member relative to the frame. More particularly, the principal object of the invention is to provide adjustment means for a reed attachment assembly of the type wherein the operative connection between the pivotable support member and frame is able to move angularly as the bridge is moved upwardly.

Further objects of the invention are to provide improved means for clamping the foot portion of a reed to the pivotable support or bridge member of a reed attachment assembly, and to provide novel frame and bridge member structures for the assembly which improve the quality of sound produced by a mouthpiece.

The many objects and advantages of the present invention will be further understood by those skilled in the art when the following description of the best mode contemplated for practicing the invention is read in conjunction with the accompanying drawing wherein like reference numerals refer to like elements and in which:

BRIEF DESCRIPTION OF THE DRAWING

FIG. 1 is a side elevation view of a mouthpiece casing for a musical wind instrument having a reed attachment assembly according to the invention mounted at the top of the casing, with portions of the reed attachment assembly being shown in dashed lines to illustrate the internal construction thereof:

FIG. 2 is an exploded view of the reed attachment assembly shown at FIG. 1;

FIG. 3 is a top elevation view of a portion of the reed attachment assembly from line 3—3 of FIG. 2;

FIG. 4 is a cross-sectional view of a portion of the reed attachment assembly shown at FIG. 1, illustrating the novel adjustment means for the reed attachment assembly; and FIG. 5 is a view similar to FIG. 4 but showing the position of elements after operation of the adjustment means.

DETAILED DESCRIPTION OF THE PREFERRED EMBODIMENT

FIG. 1 of the drawing illustrates an example of a mouthpiece 10 for a musical wind instrument such as a clarinet, comprising a mouthpiece tubular casing 12 and the novel reed attachment assembly 14 of the invention mounted in a recess 15 formed at the top of the casing 12, a reed 16 being removably clamped in a portion of the reed attachment assembly 14, as explained in further detail hereafter.

The tubular casing 12 of the mouthpiece 10, which is preferably molded of plastic, for example as a single piece, has a beak-shaped configuration defined by a cylindrical body portion 18 integrally connected to a tapered portion 19 through a reinforcing ring portion 20, with an integral smaller diameter cylindrical portion 21 extending through and protruding from an end wall 22 of the body portion 18. The tapered portion 19 of the mouthpiece 10 is open at its top and has an air intake or blowhole 24, between its tip and the tip of the reed 16, which is fluidly connected through the tubular body portion 18 to an air outlet or exhaust port 23 in the end of the cylindrical portion 21. The casing recess 15 extends from the end wall 22 of the casing to the trailing edge 25 of the casing tapered portion 19, and a conventional retainer ring 27 is fastened to the exterior periphery of the casing cylindrical protruding portion 21 for frictionally holding the mouthpiece 10 in the barrel of a wind instrument such as a clarinet, a saxophone, or the like.

As shown in detail at FIGS. 2–5, the reed attachment assembly 14 comprises a reed support or bridge member 26 pivotably supported by a frame 28, means for pivotably connecting the bridge member 26 to the frame 28 being provided in the form of a pin 30. Clamping means 32 for clamping the foot of the reed 16 to a portion of the surface of the bridge member 26, and adjustment means 34 for adjusting the inclination of the bridge member 26 relative to the frame 28 are provided.

The bridge member 26 of the reed attachment assembly 14 is preferably formed as a single piece comprising an upper panel or plate 36 and a lower panel or support plate 38, a transverse bore 40 through the support plate 38 being disposed proximate an end thereof. An end wall 42 and a generally U-shaped stirrup 46 integrally join the upper panel or plate 36 and the lower panel or support plate 38, an end portion 44 of the bridge member upper plate projecting beyond the end wall 42. The projecting, or overhanging, end portion 44 of the bridge member upper plate has a pair of downwardly extending legs 45, each having an abutment face 47.

The U-shaped integral stirrup member 46 takes the form of a pair of integral legs 49, straddling the reed 16 and interconnecting the upper and lower panels or plates 36 and 38 of the bridge member 26. As shown at FIG. 3, the frame 28 of the reed attachment assembly 14, which is also preferrably formed as a single piece, has a recessed bottom wall 48, two longitudinally extending and substantially parallel sidewalls 50, a relatively wide end wall 52 connecting the sidewalls 50 at respective ends thereof, a relatively narrow end wall 54 connecting the other ends of the sidewalls 50, a block or boss 56 formed at the top of end wall 52 proximate the middle thereof, aligned transverse bores 58 through the sidewalls 50 proximate the end wall 54, and a pair of aligned cut-out portions 60 in the top of the sidewalls 50 configured and disposed to provide clearance for the foot of the stirrup 46 of the bridge member 26.

The frame 28 as described is configured to be fitted in the recess 15 at the top of the mouthpiece casing 12 and held therein by any appropriate means, such as by cementing or bonding, for example. It has been determined that optimum results are achieved by the reed attachment assembly 14 if the recess 15 is configured such that the frame 28 attached therein extends downwardly from the casing end wall 22 at an angle, shown as "X" at FIG. 1, of between 80 and 85 degrees. To avoid sharp edges interfering with the air flow between the blowhole 24 and the exhaust port 23 when the frame 28 is affixed in the recess 15, a rearwardly and downwardly sloping bevel 62 is preferably formed in the bottom surface of the end wall 54.

After the frame 28 is affixed in the mouthpiece casing recess 15, the support plate 38 is pivotably connected thereto by the pin 30 being fitted through the aligned bores 58 of the frame side walls 50 and the transverse bore 40 of the support plate 38. The pin 30 is retained in the bores 40 and 58 by any appropriate means.

The basic operation of the reed attachment assembly 14 disclosed herein is the same as in the aforementioned co-pending application. The foot of the reed 16 is inserted through the stirrup 46 of the bridge member 26 and is removably fastened to the upper surface of the bridge member bottom panel or support plate 38 by the clamping means 32. The adjustment means 34 for adjusting the inclination of the bridge member 26 relative to the frame 28 permits a user to vary the distance between the tip of the clamped reed 16 and the forward edge or tip of the mouthpiece casing 12. However, the attachment assembly 14 herein disclosed improves in this respect on the structure disclosed in the co-pending application by moving the point of attachment between the bridge member 26 and the frame 28 forward of the second stirrup 46, adjacent to the leading edge 64 of the frame 28, FIG. 2, which improves the junction between the reed 16 and the bridge lower plate 38, thereby reducing parasitical vibrations of the reed 16.

The novel adjustment means 34 of the reed attachment assembly 14 according to the present invention comprises a screw member 66 disposed through the projecting, or overhanging, portion 44 of the bridge member 26 and threading into a collet member 68 pivotably mounted in the frame 28 proximate a corresponding end thereof. More particularly, the screw member 66 comprises a thumbscrew 70 provided with a threaded extension member 72, which is rotatably fixed through a bore 73 in the projecting portion 44 of the bridge member upper plate 36, the threaded extension member 72 threading in the collet member 68 which is pivotably disposed in a bore 75 formed in the boss 56 of the frame 28. The legs 45 straddle the boss 56 and limit the downward pivoting motion of the bridge member 26 through engagement of their abutting faces 47 with the upper surface of the frame end wall 52.

Referring now to the screw member 66 in greater detail, and as shown at FIGS. 2 and 4–5, the thumbscrew 70 has a knob 74 and a threaded shank 76. The threaded extension 72 of the screw member 66 has a cylindrical portion 78 at one end configured to be rotatably disposed in the bore 73, with an axial threaded bore 79 adapted to receive the threaded thumbscrew shank 76 and a peripherally threaded portion 80 at the other end. An integral annular shoulder 82 is disposed between the cylindrical end 78 and the threaded end portion 80. A washer 84, acting as a thrust bearing, is passed over the thumbscrew shank 76 and a washer 86, also acting as a thrust bearing, is passed over the threaded extension cylindrical portion 78. The screw member 66 is thus fastenable in the bore 73 of the bridge member overhanging portion 44, FIGS. 4 and 5, by placing the washer 86 over the threaded extension portion 78 and the washer 84 over the thumbscrew shank 76, passing the cylindrical threaded extension cylindrical portion 78 through the bore 73 such as to be freely rotatable therein and threadably engaging and tightening the thumbscrew shank 76 in the threaded axial bore 79 of the threaded extensions 72.

Referring now to the collet member 68 pivotably mounted in the bore 75 of the frame boss 56, the bore 75 is oval or elliptical, as shown at 88 at FIG. 3, the minor diameter of the bore 75 corresponding to the diameter of the body portion 90 of the collet member 68 such that the collet member 68 is angularly displaceable therein, FIGS. 4 and 5. The bottom end of the bore 75 is enlarged in a square or rectangular section, as shown at 92 at FIGS. 3-5, in which are disposed laterally extending opposite wings 94, FIG. 2, formed at the bottom of the collet member 68, such that the collet member 68 is prevented from rotating when disposed within the bore 75, and the screw member 66 is rotated such as to engage the peripherally threaded portion 80 of the threaded extension 72 within the threaded bore 95 of the collet 68. The upper surface of the collet member laterally extending wings 94 engages the bottom surface of the shoulder formed between the eliptical bore 88 at the enlarged end portion 92 thereof, thus preventing the collet member 68 from being pulled from the bore 75. An elastically deformable and resilient gasket 96, made of rubber for example, is retained compressibly and is cemented at its edges in the enlarged rectangular or square portion 92 of the bore 75, such as to enable pivoting of the collet member 68, while preventing the collet member 68 from being pushed through the bore 75. As previously mentioned, the advantage presented by the novel attachment means 14 as heretofore described is that the operative connection between the bridge member 26 and the frame 28, i.e. the common axis of the screw member end portion 80 and of the axial threaded bore 95 of the collet member 68 is able to move angularly and pivot from an axis "y" to an axis "y'" as the bridge 26 is moved upwardly.

The novel means 32 for clamping the foot of the reed 16 to the bridge member lower panel or support plate 38 comprises a pair of thumbscrews 102 and 102', each threading in an insert 104 and provided at its end with a clamping plate 106. The thumbscrews 102 and 102' each have a knob 108 and an integral threaded shank 110 provided with a threaded axial bore 112 extending through the end thereof. The inserts 104 each have a cylindrical body portion 116 provided at an end with a shoulder 114, and a longitudinal threaded bore 118. Each clamping plate 106 or 106' has a disk-shaped end portion 120 provided with a threaded projecting shank 122. Each insert 104 is press-fitted, threaded or otherwise suitably affixed in each of two bores 124, one formed proximate the middle of the bridge member upper panel 36, and the other substantially at the junction of the bridge member upper panel 36 and the second stirrup 46. The threaded shank 110 of each of the thumbscrews 102 and 102' is threadably engaged within the threaded bore 118 of each insert 104, and the threaded shank 122 of each clamping plate 106 or 106' is suitably threaded tight in the axial threaded bore 112 of one of the thumbscrew shanks 110. By manually rotating the thumbscrews 102 and 102' in an appropriate direction with the reed 16 placed at its foot between the bridge member upper panel or plate 36 and the reed support plate 38, the reed 16 is suitably clamped within the bridge member 26 as a result of the pressure exerted on the surface of the reed 16 by the relatively large area of the disk-shaped portion 120 of each clamping plate 106. By loosening the thumbscrews 102 and 102' the longitudinal position of the reed 16 may be adjusted, or the reed replaced by another one. After the reed 16 has been clamped in the bridge member 26 in an appropriate position, the inclination of the bridge member 26 is adjustable by manipulating the adjusting thumbscrew 34, such that the width of the air intake or blowhole 24 may be adjusted as most suitable to a specific musician's technique.

It will be apparent to those skilled in the art that the various elements of the reed attachment assembly 14 can be made of any suitable material, preferably a lightweight metal, and that although the mouthpiece casing 12 shown in the drawing is typical of a clarinet mouthpiece, it will be appreciated that the invention is applicable to other instruments having a vibrating reed, such as saxophones and the like, for example.

Having thus described the present invention by way of an example of structure well adapted to accomplish the purpose of the invention, modification whereof will be apparent to those skilled in the art, what is claimed as new is as follows:

I claim:

1. A mouthpiece for a musical wind instrument comprising a tubular casing and a reed attachment assembly mounted on the top of said casing, said reed attachment assembly comprising a frame attached to said casing, a bridge member pivotably connected at an end to said frame, means for removably and adjustably attaching the foot portion of a reed to said bridge member, and adjustment means for adjusting the inclination of said bridge member relative to said frame, said adjustment means comprising a threaded member rotatable in said bridge member, means preventing longitudinal displacement of said threaded member, and an internally threaded collet member pivotably mounted in said frame proximate the other end thereof, wherein a portion of said threaded member is threadably engagable in said pivotable collet member.

2. The mouthpiece of claim 1 wherein said frame has a bore at said other end thereof and said pivotable collet member is held against rotation in said bore.

3. The mouthpiece of claim 2 wherein an elastically deformable and resilient gasket is disposed between an end of said collet member and an end of said bore.

4. The reed attachment assembly of claim 2 wherein said frame transverse bore is elliptical in cross-section and has a lower portion which is rectangular in cross-section, and wherein said collet member has a body portion which is circular in cross-section and an end portion which is rectangular in cross-section fitted in said bore rectangular portion.

5. The mouthpiece of claim 1 wherein said threaded member comprises a threaded extension and a thumbscrew, said threaded extension having a cylindrical top portion rotatably disposed through a bore in said bridge member and a peripherally projecting shoulder, a threaded axial bore extending through the end of said cylindrical top portion, said thumbscrew having a knob and a projecting threaded shank affixed in said axial bore such that rotation of said knob causes rotation of said threaded extension.

6. The reed attachment assembly of claim 1 wherein said bridge member comprises a top plate and a bottom plate integrally connected at an end by an end wall and at the other end by a stirrup member affording passage therethrough to said reed.

7. The mouthpiece of claim 6 wherein said means for removably and adjustably attaching the foot portion of said reed comprises a threaded bore in said bridge member top plate, a thumbscrew threading through said threaded bore in said bridge member top plate, and a clamping plate attached to the end of said thumbscrew for clamping said reed against said bridge member bottom plate.

8. A mouthpiece for a musical wind instrument comprising a casing, a reed and a reed attachment assembly mounted at the top of said casing, the reed attachment assembly comprising a bridge member pivotably connected to a frame, said frame being fixed to said casing and said bridge member having a top plate and a lower plate between which the foot of said reed is installed, clamping means on said top plate for clamping the foot of said reed against said lower plate, a pivot support means pivotably attaching said bridge member to said frame at one end of said bridge member, adjustment means for adjusting the inclination of said bridge member relative to said frame, said adjustment means comprising a threaded member journaled through a bore in said bridge member and an internally threaded socket member disposed in said frame, said threaded member having shoulder abutment means preventing longitudinal motion thereof, and said socket member being attached to said frame by means allowing pivoting of said socket member for alignment with said threaded member and preventing longitudinal motion of said socket member.

9. The mouthpiece of claim 8 wherein said clamping means is at least one thumbscrew threading through a threaded bore in said bridge member top plate, said thumbscrew having a clamping plate mounted on the end thereof for engagement with a surface of said reed.

* * * * *